US005977469A

United States Patent [19]

Smith et al.

[11] Patent Number: 5,977,469

[45] Date of Patent: Nov. 2, 1999

[54] REAL-TIME WAVEFORM SUBSTITUTING SOUND ENGINE

[75] Inventors: David L. Smith, St. Helena, Calif.; David T. Roach; Frank T. Kurzawa, both of Austin, Tex.

[73] Assignee: Seer Systems, Inc., Portola Valley, Calif.

[21] Appl. No.: 08/784,372

[22] Filed: Jan. 17, 1997

[51] Int. Cl.[6] ..... G10H 1/02; G10H 7/00

[52] U.S. Cl. ..... 84/627; 84/663

[58] Field of Search ..... 84/603, 604, 624, 84/627, 663

[56] References Cited

U.S. PATENT DOCUMENTS 4,520,708 6/1985 Wachi ..... 84/627 X
4,635,520 1/1987 Mitsumi ..... 84/627 X
5,262,581 11/1993 Sharp ..... 84/603
5,324,882 6/1994 Ohta et al. ..... 84/604
5,466,882 11/1995 Lee ..... 84/603

*Primary Examiner*—Jeffrey Donels
*Attorney, Agent, or Firm*—Carr & Ferrell LLP

[57] ABSTRACT

A sound engine in a processor-based system utilizing real-time synthesis optimizes synthesis time, maximizes the number of fully-synthesized sound requests and preserves currently excessive sound requests. During synthesis, the sound engine attempts to full-synthesize all requests. If the sound engine determines that remaining sound requests are excessive and cannot be fully-synthesized, it preserves each excessive request by synthesizing a substitute waveform segment. If the sound engine determines that limiting the number of preserved requests is required, it synthesizes a concluding waveform segment for and then discards selected requests during selected synthesis intervals. Both substitute-synthesis and discarding of sound requests are achieved with minimized detrimental impact on ongoing sound performances.

43 Claims, 7 Drawing Sheets

REAL-TIME WAVEFORM SUBSTITUTING SOUND ENGINE

BACKGROUND OF THE INVENTION

1. Field of the Invention

This invention relates to sound production systems and more particularly to a sound engine that preserves requests for synthesis of sound waveforms such that if its capacity for real-time synthesis is exceeded, then impact on an ongoing sound performance will be minimized.

2. Discussion of the Prior Art

In processor-based sound production systems, such as personal computers ("PCs") utilizing real-time synthesis, sound generating processes, such as multimedia programs, send requests for sound to a sound engine. The sound engine manages the sound requests and synthesizes corresponding digital waveforms, and an audio output system converts the digital waveforms into audible sounds.

Although sound-generating processes may request sound as digitally recorded segments to be played back as with a conventional tape recorder, event-based sound production is favored as being more responsive for producing interactive sounds while producing acceptable ongoing sound such as soundtracks. It is also favored as requiring the generation and storage of far less data. With event-based sound production, such as according to the Musical Instrument Digital Interface ("midi") and General Musical Instrument Digital Interface ("General midi") standards, sound-generating processes send sound requests, including instructions for how to create requested sounds, to the sound engine. The sound engine creates or "synthesizes" digital waveforms according to the instructions, similarly to a player piano pressing keys according to the arrangement of holes in a piano roll. A General midi sound request might for example include an instruction to start synthesizing ("note-on") a specific pitch ("note") for a specific sound quality or "instrument" such as middle-C on a piano. Upon receipt of the sound request, the sound engine not only initiates but continues to synthesize a piano sound throughout the sound's characteristic duration unless it receives a request to stop synthesizing the sound ("note-off").

Since a processor-based sound engine necessarily synthesizes waveforms serially, the audio output system uses a conventional double-buffering system to create a continuous waveform that will produce continuous sound. A double-buffering system includes two buffers that alternate input and output tasks on a regular and continuous basis. While one buffer is available to receive a waveform for a given period of time ("one cycle"), the other buffer is continually outputting individual parts ("samples") of the previous waveform to a digital-to-analog converter. When a cycle ends ("times-out"), the buffers switch tasks and continue outputting samples without interruption.

While each double-buffering cycle times-out in only several milliseconds, a typical sound lasts several seconds. Thus, the sound engine will ideally synthesize a waveform corresponding to each of any number of sounds requested in segments ("waveform segments") with each segment having a duration of one cycle and each complete waveform having a duration of typically a few to several hundreds of samples. In addition to continuing waveforms, the sound engine will ideally synthesize a waveform segment corresponding to each request for a new sound as it receives the request. Inconveniently, since PCs are not exclusively dedicated to producing sound, the processor may be interrupted at an unpredictable time for an unpredictable interval during any given cycle.

Thus, the need to produce sounds interactively, combined with the need to produce continuous sound using processor-based systems that are not exclusively dedicated to producing sound, causes problems if the sound engine receives more sound requests than it can fully synthesize in real-time.

In prior PC-based sound production systems, excess sound requests have been summarily and irrevocably discarded both upon receipt and again during synthesis. At the start of each double buffering cycle the total number ("playable number") of synthesizable waveform segments is calculated as a presumed processor-available time divided by the sum of a mean time for fully synthesizing an average complexity waveform plus additional time to account for potentially more complex waveforms and processor interruptions. The sound engine then irrevocably discards any requests for sound in excess of the playable number and begins fully synthesizing the remaining ("planned") sound requests. When the current cycle times out, the sound engine irrevocably discards all planned sound requests that it has not yet synthesized.

While summarily discarding sound requests assures that the capacity of a sound engine is not exceeded due to processor interruptions, it conflicts with the sound engine's very purpose: synthesizing requested sounds as accurately and completely as is possible. Accurate synthesis is important not only in initiating requested sounds, but also in sustaining and concluding sounds that were initiated earlier.

The FIG. 1*a* graph shows how conventional non-discriminating, irrevocable and abrupt discarding of sound requests results in the loss of auditory cues and sound textures. Most naturally occurring sounds 110, such as piano sounds, have a characteristic attack portion 110*a*, sustain portion 110*b* and concluding portion or "release" 110*c*. In the piano example, a hammer hitting the strings causes attack portion 110*a*, sound 110 sustains 110*b* while the key is depressed and sound 110 concludes 110*c* after sufficient time has elapsed or when the key is released. Portions of sound 110 not only provide sonic texture, but also provide a listener with sonic cues. When conventional sound engines discard a sound request, the corresponding sound 110 ends abruptly, thereby preempting cues provided by remaining portions of sound 110. Thus, if a sound request is discarded at $t_1$ prior to a sound's attack at time $t_2$, the entire sound 110 is lost. If the sound 110 provided a critical system warning, musical event or interactive cue, then that is lost as well. If a sound request is discarded at time $t_4$ during a sound's sustaining portion, then the attack portion 110*a* of sound 110 is not affected. However, the remaining duration 120*b* of sound 110 is lost along with the texture and cues provided by the remainder of sustaining portion 110*b* and release 110*c*. Thus, during each double-buffering cycle conventional sound engines discard many sounds, along with the respective textures and cues they provide, indiscriminately at any point during their duration and without consideration of their sonic importance. Therefore, the integrity of a sound performance might be severely compromised.

The FIG. 1*b* graph, by magnifying portion 200 of the FIG. 1*a* graph, shows how conventional, non-discriminating, abrupt, and irrevocable discarding 115*b* of a sound request during the corresponding sound sustaining portion 110*b* or concluding portion 110*c* introduces readily perceived noise. Abruptly discarding 115*b* a sound request immediately ceases all synthesis of a corresponding sound 110, resulting in a total lack of the sound 110 or equivalently a waveform 110*e* having a constant zero amplitude. Since it is extremely unlikely that the amplitude of the last sample prior to discarding 115*b* will be zero, a difference in amplitudes ("waveform discontinuity") occurs at time $t_4$. This waveform discontinuity, after mixing with other sounds and amplification, is perceived by listeners as a loud, obnoxious, popping sound followed by the sudden absence of the remainder of the sound as well as a loss of the textures and cues that the request-initiating process intended the sound to provide. To make matters worse, conventional sound engines may discard any number of sound requests during each typically ten to twelve millisecond cycle.

The conventional sound engine solution of completely and irrevocably discarding sound requests is also inconsistent with the problem that it is intended to solve, ie., temporarily exceeded sound engine capacity. Exceeded sound engine capacity is most often due to processor interruption during synthesis. While conventional sound engines discard excess sound requests during each cycle in anticipation of processor interruption, such processor interruption might not and in many cases does not occur. Further, processor interruption and resultant exceeded sound engine capacity during a current cycle indicates a greater likelihood of sufficient capacity during successive cycles when synthesis of such sound requests might be continued. Thus conventional discarding of sound requests is in both cases premature; a waste of time better reserved for fully synthesizing more requests; and might needlessly, severely and detrimentally impact an ongoing sound performance.

Thus, there is a need for a sound engine that makes better use of time and equipment resources to synthesize sounds.

SUMMARY OF THE INVENTION

The present invention provides a processor-based sound engine which first attempts to fully synthesize all sound requests and if during such synthesis the sound engine determines that insufficient time remains for full-synthesis of all remaining sound requests, then it preserves such sound requests for synthesis during successive cycles.

Accordingly, a first embodiment of the present invention comprises a sound engine that, prior to full-synthesis of a next sound request, determines whether sufficient time remains for synthesis of remaining requests and if so, fully synthesizes the next request. Otherwise, the sound engine of the invention preserves the remaining requests.

The second embodiment of the present invention further comprises a sound engine that avoids an excessive number of preserved sound requests by periodically discarding a number of preserved sound requests. The sound engine of the invention further avoids resultant noise by performing modulated synthesis of the sound requests before they are discarded.

These and other objects, advantages and benefits of the present invention will become apparent from the drawings and specification that follow.

DETAILED DESCRIPTION OF THE PREFERRED EMBODIMENTS

Figure 1A:
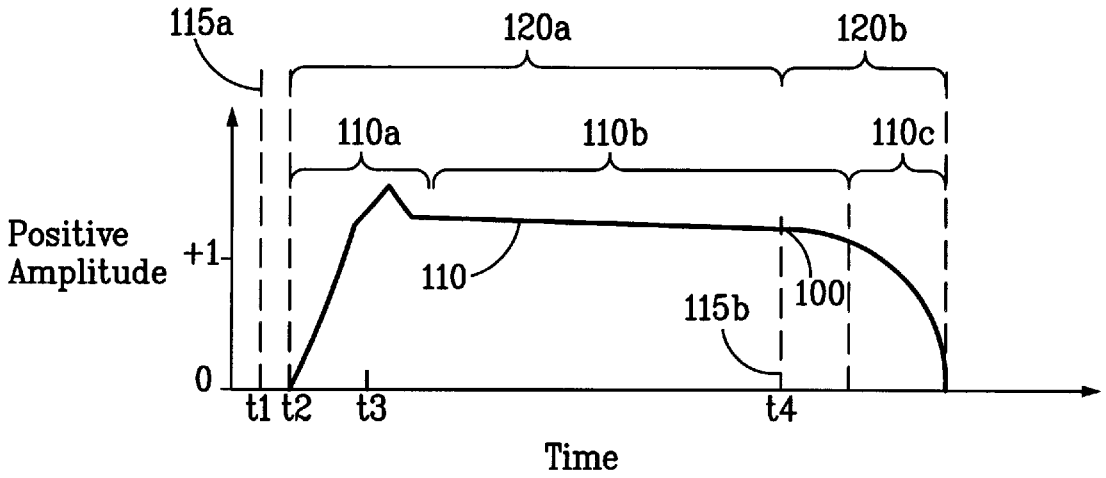
FIG. 1A Prior Art
FIG. 1*a* is a graph showing how conventional non-discriminating, abrupt and irrevocable discarding of sound requests detrimentally impacts a sound performance.
Figure 1B:
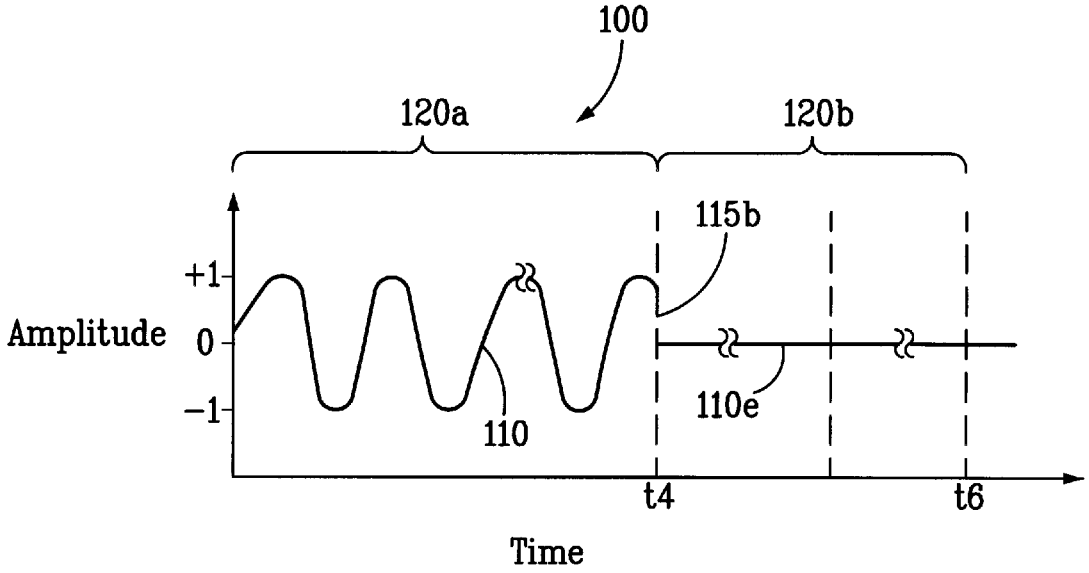
FIG. 1B Prior Art
FIG. 1*b* is a graph enlarging a portion of FIG. 1*a* to show how conventional nondiscriminating, abrupt and irrevocable discarding of a sound request during the sustaining or concluding portion of corresponding sound 110 introduces noise.
Figure 2A:
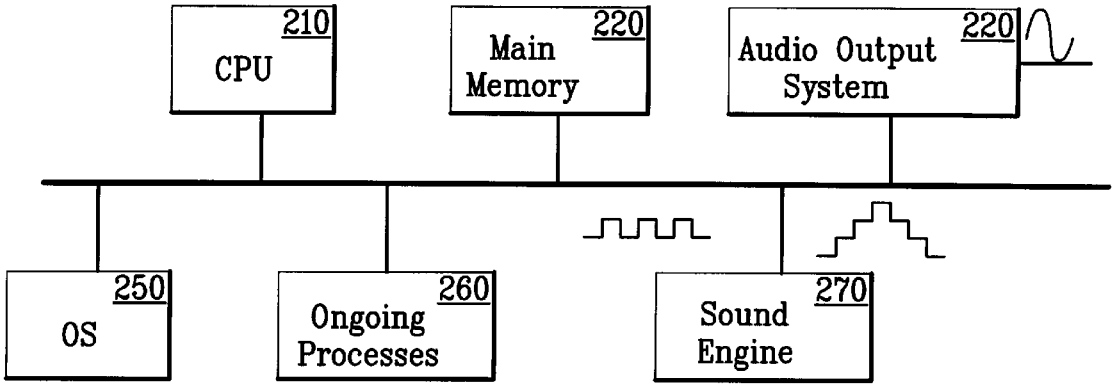
FIG. 2*a* is a simplified functional diagram of the hardware and software elements of a system in accordance with the invention.
Figure 2B:
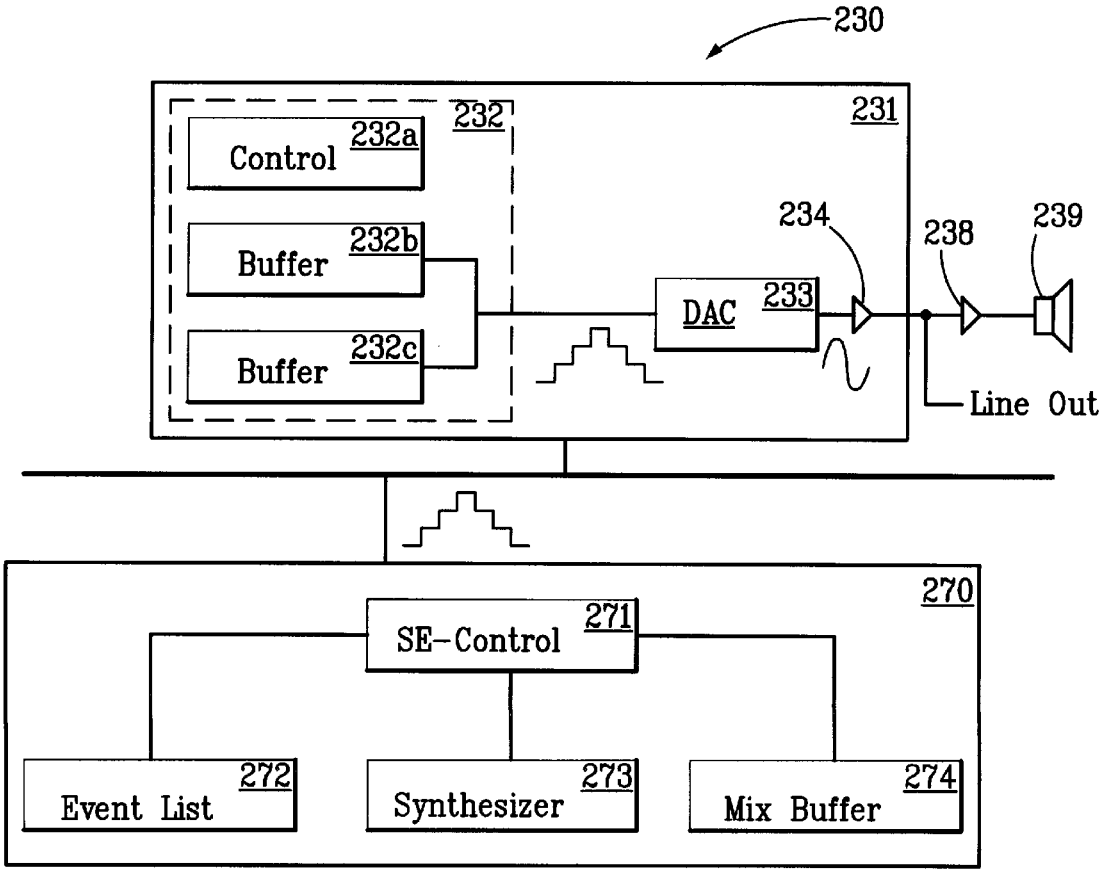
FIG. 2*b* is a detailed view of the FIG. 2*a* diagram showing the functional components in the sound engine and audio output system according to the invention.

FIGS. 2*a* and 2*b* illustrate how the sound engine 240 of the present invention is functionally positioned within a personal computer ("PC") 200 for the production of sound. PC 200 comprises electrically connected hardware elements including processor 210, memory 220 and audio output system 230, and software elements including operating system 250, ongoing processes 260 and sound engine 270: Operating system 250 and other ongoing processes 260 requiring sound send sound requests to sound engine 270. Upon receipt of requests, sound engine 270 synthesizes corresponding digital waveforms and sends them to audio output system 230. Audio output system 230, using digital-to-analog ("D/A") converter 233 (FIG. 2); amplifiers 234 and 238; and speaker 239 in a conventional manner, converts the received digital waveforms to audible sound.

A single audio channel or "monophonic" system is presented throughout for illustrative purposes only. A system according to the invention is equally capable of actual and perceived multi-channel, spatially distributed and other synchronized sound production through conventional internally and/or externally assisted encoding and element duplication means.

FIG. 2*a* is detailed in FIG. 2*b* showing the functional components of sound engine 270 and audio output system 230. Sound engine 270 includes controller 271, event list 272, synthesizer 273 and mix buffer 274. Audio output system 230 includes sound card 231 having a conventional double-buffering system 232, digital-to-analog converter 233 and amplifier 234. Double-buffering system 232 includes controller 232*a*, first buffer 232*b* and second buffer 232*c*. Audio output system 230 also includes amplifier 238 and speaker 239 which are not mounted on sound card 231.

Continuous sound is provided through the regular and continuously alternating cycles of double-buffering system 232. For each sound request to be processed during the current double-buffering cycle ("cycle"), synthesizer 273 synthesizes a cycle-long waveform segment and adds it to mix buffer 274. Before the current cycle times out, sound engine 270 sends the composite waveform segment from mix buffer 274 to double-buffering system 232 for storage in first sound buffer 232*b*.

When the current cycle times out, double-buffering system 232 begins transferring the composite waveform segment from first sound buffer 232*b* to D/A converter 233 and, at the same time, makes second sound buffer 232*c* available to receive waveform segments from sound engine 270. This process is repeated continuously during successive cycles alternately using sound buffers 232*b* and 232*c*. Thus, after the last waveform sample of either sound buffer 232*b* or 232*c* has been sent to D/A converter 233, the first waveform sample of the alternate sound buffer 232*c* or 232*b* is sent without interruption.

While the speed of the PC components and specific sound card 260 affect the speed of double-buffering system 232, each cycle is executed continuously with a consistent duration of between typically one and thirty milliseconds. Thus, the maximum capacity of sound engine 270 and the maximum number of simultaneous sounds ("polyphony") that PC 200 (FIG. 2*a*) can produce is limited by the number of waveform segments ("voices") that sound engine 270 can produce during a double-buffering cycle.

While an observed gross maximum number of eighty or more voices may seem more than sufficient, the capacity of sound engine 270 to synthesize a waveform segment corresponding to all requests for sound ("requests") from all sound-generating processes can nonetheless be exceeded. For example, a game process might generate requests corresponding to each note for each instrumental sound in a musical background as well as each interactive sound effect in response to user actions. These sounds can also include complex voices requiring longer synthesis times. In addition, each sound has a duration of typically several seconds or several hundred double-buffering cycles. Thus, sufficient sound engine 232 capacity might be required during a current cycle to initiate synthesis of new voices corresponding to newly received requests ("new requests") as well as voices for requests received during prior cycles for which a corresponding sound has not yet concluded ("still-active requests"). To make matters worse, sound engine 270 is processor-intensive and if processor 210 is needed for handling other processes such as multiple disc accesses, then synthesis may be interrupted for an indeterminate interval during any cycle.

In a not-exclusively-dedicated real-time system, certain variables remain unresolved until synthesis begins (and sometimes longer until the occurrence of a specific event). Such variables include the maximum number of waveforms that can be synthesized simultaneously, the importance of each new or still-active request in providing musical characteristics or feedback, the prominence of a new or still-active request at a specific time during a sound performance, whether processor 210 will be interrupted, and if processor 210 is interrupted how much time will remain for synthesis after the interruption. Therefore, in contrast to prior art sound engines, the present invention does not utilize the limited synthesis time available to calculate polyphony, or set aside time to account for potential processor interruptions and for processing unusually complex waveforms at the start of each cycle. As will be explained more fully below, bare discarding of waveform segments introduces readily perceived noise and should therefore be avoided. Thus, for these and other reasons, the invention does not discard potentially critical or prominent new or still-active requests at the start of each double-buffering cycle, as was the prior art practice.

FIGS. 2*a* through 5 show a first embodiment of the present sound engine 270 according to the invention that, prior to full synthesis of a next request, determines whether sufficient time remains for synthesis of remaining requests and if so fully synthesizes the next request. Otherwise, the present sound engine 270 preserves the remaining requests for successive cycles during which sound engine 270 capacity will likely be sufficient for fully synthesizing such requests.

Figure 3A:
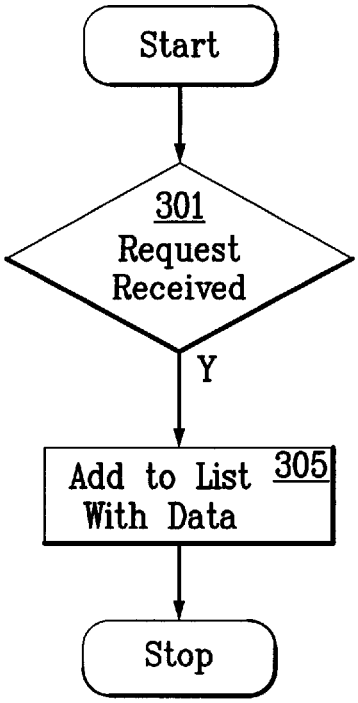
FIG. 3*a* is a flowchart showing how the sound engine stores sound requests in an event list.
Figure 3B:
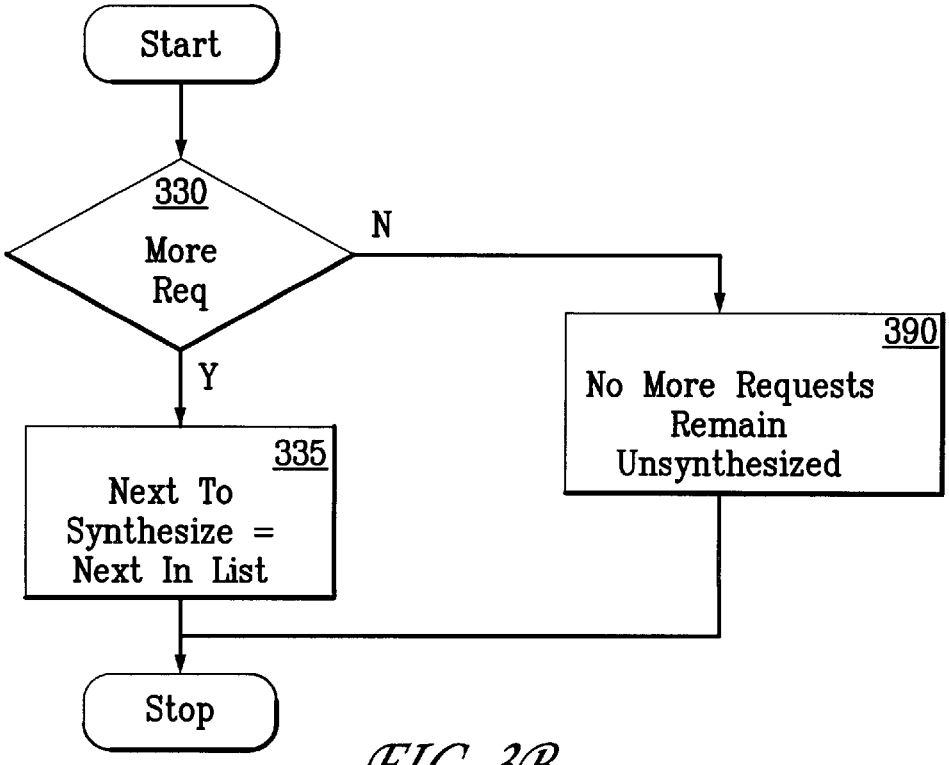
FIG. 3*b* is a flowchart showing how the sound engine determines if more events remain to be synthesized.

FIGS. 3*a* and 3*b* show how requests are stored in event list 272 upon receipt and then gathered from event list 272 during synthesis. While other means might be utilized for this purpose, on-receipt storage of requests and retrieval of requests from an event list during synthesis as described below are used for illustrative purposes. Requests might for example be synthesized upon receipt until sound engine throughput is maximized, and then stored as needed for continued synthesis during successive cycles. Other means, many of which are conventionally known, might also be utilized.

The FIG. 3*a* flowchart shows how sound engine 270, upon receipt, stores sound requests in event list 272. If in step 301 a request is received, then the request is added as the next element of event list 272.

The FIG. 3*b* flowchart shows how the sound engine 270, during synthesis, determines whether more events remain to be synthesized and, if so, then fetches a next sound request for synthesis. If in step 330 more requests remain in event list 272, then they have not yet been synthesized during the current cycle and in step 335 the last request received by event list 272 that has not yet been synthesized is considered the next request to be synthesized. If in step 330 no more requests exist, then in step 390 all requests have been synthesized during the current cycle.

Figure 4:
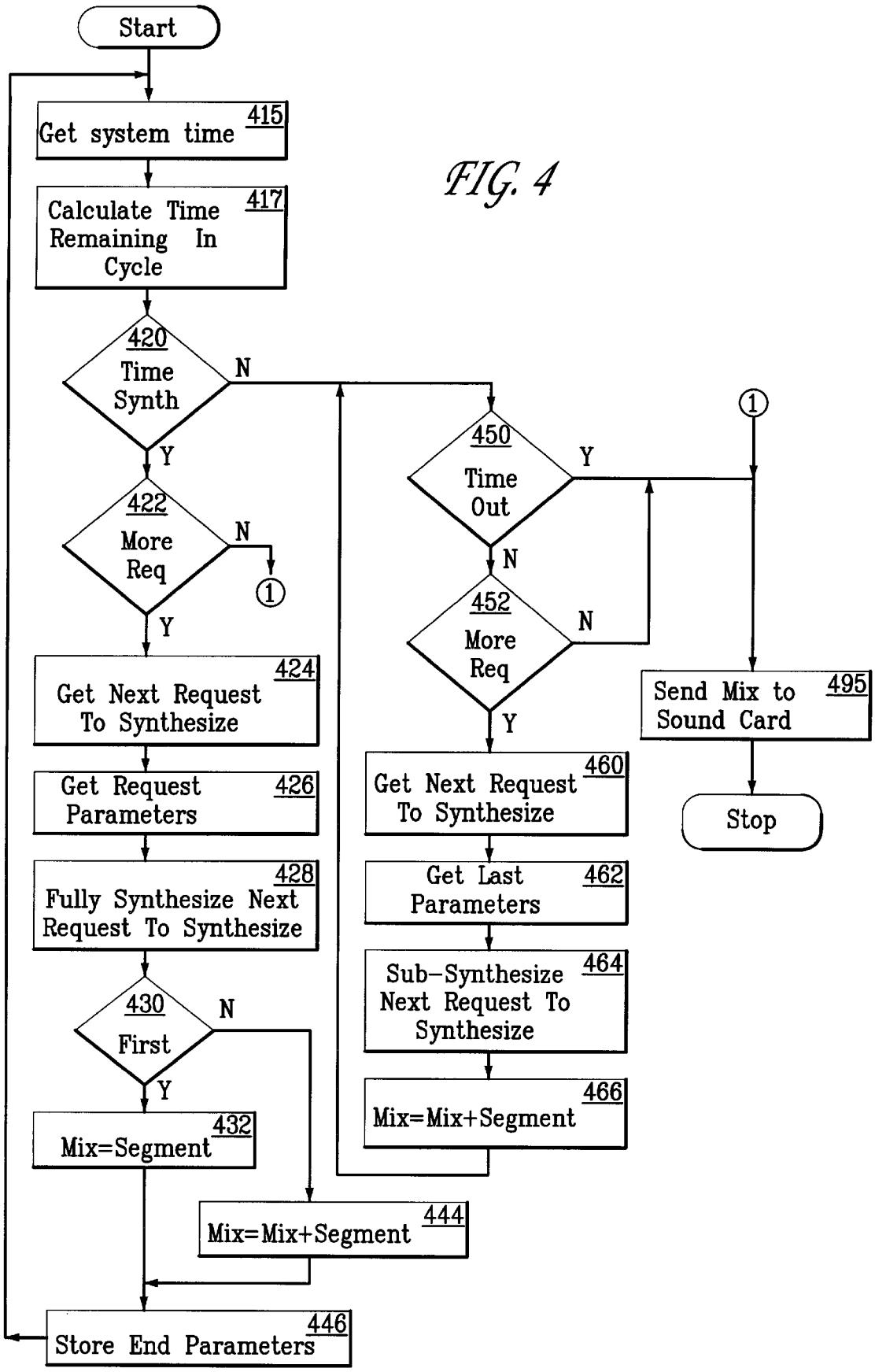
FIG. 4 is a flowchart showing how the sound engine, according to a first embodiment, fully synthesizes non-excessive requests and uses substitution-synthesis to preserve excessive requests.
Figure 5:
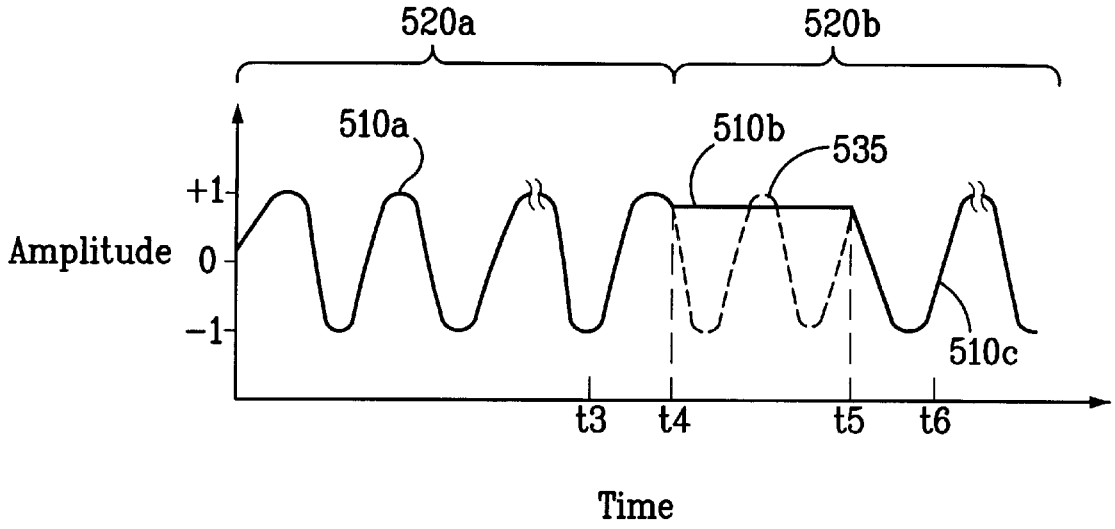
FIG. 5 is a graph showing how D.C. waveform segments are substituted for each temporarily "not-fully-synthesized" request.

FIGS. 4 and 5 show how allotting time for and utilizing waveform substitution in combination with per-request time referencing during synthesis according to the first embodiment of the invention minimize the impact on sound performances if the sound engine 270 capacity is exceeded. While the ideal "full-synthesis" of all requests might be prevented by processor 210 (FIG. 2*a*) interruption and resultant exceeded sound engine capacity, the detrimental impact on an ongoing sound performance should nonetheless be minimized. Thus, an alternative measure maximizes the number of requests that are fully synthesized, confines as much of the detrimental impact as possible to the offending cycle and otherwise minimizes the detrimental impact during the current cycle. Further, while certain characteristics of such an alternative might be measured and calibrated, the success of the alternative utilized depends almost entirely on the effect as perceived by listeners during a sound performance.

The FIG. 4 flowchart shows how sound engine 270, according to a first embodiment of the invention, fully synthesizes non-excessive requests and, using "substitution-synthesis" preserves excessive requests to minimize the detrimental impact on a sound performance. First, the system time is input in step 415 and used in step 417 to calculate the time remaining before the end of the current cycle by comparison to the time the sound is expected to finish playing through the current buffer. If in step 420 time remains during a time allotted for full synthesis ("full-synthesis-time"), then sound engine 270 fully synthesizes a waveform segment.

Full-synthesis-time is an approximated time reserved for fully synthesizing requests while reserving time for synthesizing substitute waveform segments for those requests that cannot be synthesized during the current cycle. While full-synthesis-time will vary due to the variety of PCs 200, operating systems 250, sound cards 231 and other factors, it is typically calculated as three-tenths of a percent to ten percent of the actual playback time. Since a substitute waveform, as will be discussed, is synthesized in approximately one-twentieth of the time required for full synthesis, such a full-synthesis-time results in sufficient time to synthesize typically between six and two hundred substitute waveforms.

If in step 422 a request remains in event list 272 that has not yet been synthesized during the current cycle, then in step 424 event list 272 is searched for the next request to be synthesized; in step 426 synthesis parameters for the request are retrieved from event-list 272; and in step 428 a waveform segment corresponding to the request is fully synthesized. If in step 430 the waveform segment is the first waveform segment synthesized during the current cycle, then in step 432 it replaces the contents of, and thereby initializes, mix buffer 274. If in step 430 the waveform segment is not the first one synthesized, then in step 444 the waveform segment is added ("mixed") with the contents of mix buffer 274 to form a composite waveform segment including all waveform segments synthesized thus far during the current cycle. In step 446, synthesis parameters corresponding to the state of the last sample of the waveform segment replace those previously stored for the synthesized request in event list 272.

If in step 422 no requests remain unsynthesized during the current cycle, then all pending sound requests have been fully synthesized during the current cycle, and in step 495 sound engine 270 sends the contents of event list 272 to sound card 231 (FIG. 2*b*).

If in step 420 there is less than full-synthesis-time remaining in the current synthesis cycle, but in step 450 the current cycle has not yet timed-out, then in step 452 event list 272 is searched for a request that has not yet been synthesized during the current cycle. If in step 452 such a request is found, then in step 460 event list 272 is searched for the next request to be synthesized; in step 462 the amplitude corresponding to the request is retrieved from event-list 272; in step 464 a substitute waveform segment corresponding to the request is synthesized; and in step 466 the substitute waveform segment is added to the contents of mix buffer 274.

If in step 450 the current cycle has timed-out or if in step 452 no requests remain unsynthesized during the current cycle (such that a fully synthesized waveform segment or a substitute waveform segment has been synthesized for all requests during the current cycle), then in step 495 sound engine 270 sends the contents of event list 272 to sound card 231 (FIG. 2*b*) and the process ends.

Sound engine 270, by allotting time for and utilizing waveform substitution in combination with per-request time referencing during synthesis, thus satisfies each of the requisites for an alternative to the ideal of fully synthesizing all pending requests in all cases. Since the short interval required for preserving each excessive request permits reserving a similarly short interval for substitute synthesis of all excessive requests, full-synthesis-time is sufficiently long that in most cases all pending requests will be fully synthesized. Further, since sound engine 270 in steps 415, 417 and 422 uses time remaining in a current cycle before synthesis of each pending request, a shortening of full-synthesis-time will only occur where the capacity of sound engine 270 is actually exceeded. Thus, the number of requests that are fully synthesized is maximized both generally and during an offending cycle. For the same reasons, in almost all cases substitute-synthesis only impacts a sound performance during a cycle in which the capacity of sound engine 270 is in fact exceeded. Thus, in contrast with conventional sound engines, present sound engine 270 does not needlessly waste synthesis time by prematurely discarding requests.

The FIG. 5 graph with reference to FIG. 4 shows how the use of substitute waveform segments for synthesizing each temporarily not-fully-synthesized request minimizes the detrimental impact on a sound performance if the sound engine's capacity is exceeded. While other forms of substitute-synthesis might be used, the present alternative is very efficient and results in little if any detrimental impact perceptible to a listener. Substitute waveform segment 510*b* results from synthesizing in step 464 a single amplitude waveform segment having an amplitude retrieved in step 462.

The use of a single-amplitude, amplitude-matching substitute waveform has several advantages. First, since the substitute waveform segment 510*b* amplitude was stored in step 446 (FIG. 4) among other synthesis parameters corresponding to the state of the last sample of waveform segment 510*a* (FIG. 5) during the last full-synthesis cycle for the request, no waveform discontinuity exists at time $t_4$. Similarly, since in step 426 synthesis parameters gathered for full-synthesis during the next full-synthesis cycle include the same amplitude, the first sample of waveform segment 510*c* for the request following substitute synthesis has the same amplitude and no waveform discontinuity exists at $t_5$. In addition, since the substitute waveform requires no calculation, it can be synthesized or added directly to mix buffer 274 (FIG. 2*b*) in typically about one-twentieth of the time required to synthesize a fully-synthesized waveform of average complexity, thereby maximizing synthesis time as opposed to conventional discarding of requests. Further, while the phase of the waveform segment 510*c* is likely inconsistent with that of a fully-synthesized waveform segment 535, the resultant perceived noise is far less than that from conventionally discarding requests. In addition, since exceeded sound engine 270 capacity is in most cases accompanied by a large number of simultaneous sounds, the perceived noise is usually effectively masked.

Since the capacity of sound engine 270 is typically only intermittently exceeded, sufficient sound engine 270 capacity will likely exist during successive cycles for full-synthesis of all requests. Thus, the silence produced by substitute waveform segment 510*b* lasts for only several milliseconds and is essentially not perceptible. Just as importantly, use of substitute-synthesis when sound engine 270 capacity is in fact exceeded preserves requests for full-synthesis during successive cycles.

Figure 6A:
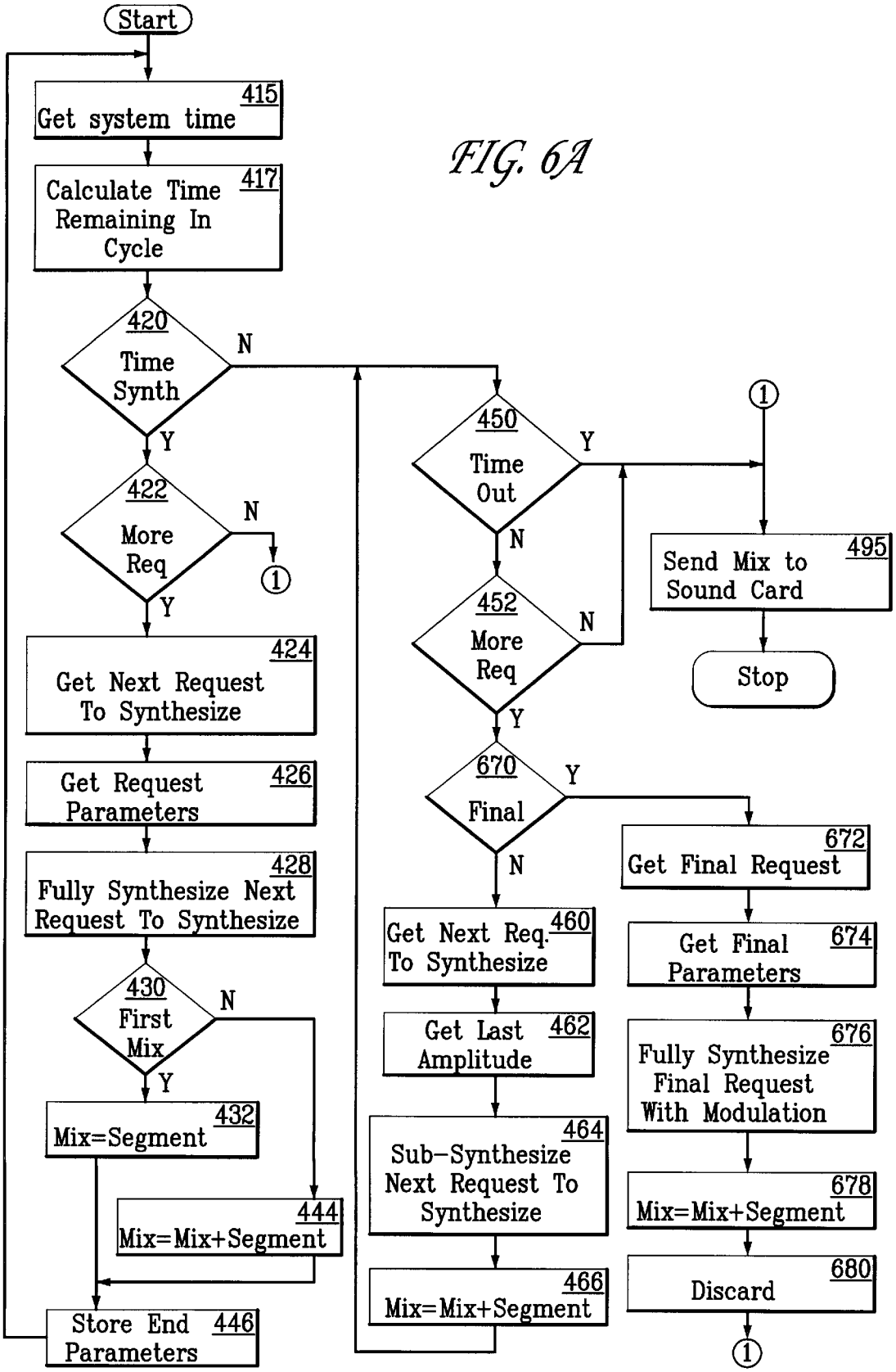
FIG. 6*a* is a flowchart showing how to discard excessive requests, the sound engine according to a second embodiment provides a final waveform segment.
Figure 6B:
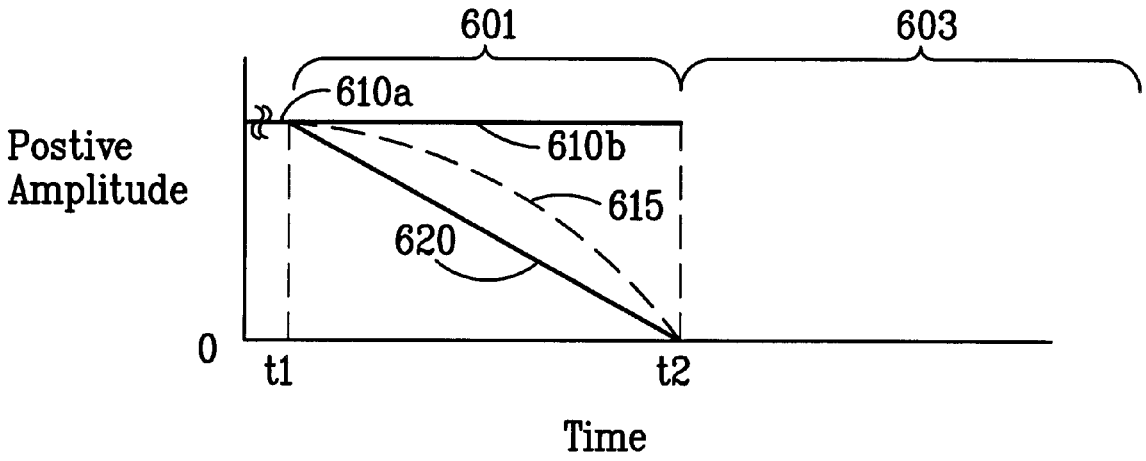
FIG. 6*b* is a graph showing how a modulated "fully-synthesized" final waveform segment is used when discarding waveform segments.

FIGS. 6*a* and 6*b* show how the second embodiment of the present invention further comprises a sound engine that controls an increasing number of preserved sound requests during successive periods of exceeded capacity, by periodically discarding a number of preserved sound requests. The sound engine further comprises avoiding noise otherwise created in discarding sound requests, by performing modulated synthesis of sound requests to be discarded.

The FIG. 6*a* flowchart shows how sound engine 270 provides a concluding waveform segment to allow discarding excessive preserved requests with a minimal detrimental impact on a sound performance. While it is infrequent that the capacity of sound engine 270 is continuously exceeded, the result of such an occurrence where requests are preserved according to the first embodiment might be an unmanageable number of requests preserved by substitute-synthesis. Thus, while discarding of requests should in most cases be avoided, it becomes necessary in some cases.

However, in such cases the negative impact of discarding requests conventionally is avoided.

Per-request system time checking and full-synthesis during a full-synthesis-time according to steps 415 through 446 (FIG. 4) of the first embodiment are the same in the second embodiment. Steps relating to discarding requests are added to substitute-synthesis. Thus, sound engine 270 having determined in step 450 that a time-out has not occurred and in step 452 that more requests exist, in step 670 determines whether the current request is the last request ("final request") remaining unsynthesized during the current double-buffering cycle. Since events are stored in event list 272 (FIG. 2*b*) upon receipt of requests and then retrieved in the reverse order of receipt the final request will also be the current oldest request. Thus, discarding this request will likely remove a sound that is no longer of great importance to a sound performance. If in step 670 the current request is not the final request, then steps 460 through 466, which relate to substitute-synthesis of the current request, occur as in the first embodiment. If in step 670 the current request is also the final request, then in step 672 sound engine 270 gets the final request from event list 272; in step 674 gets the parameters for the final request; in step 676 fully-synthesizes the final request with modulation; in step 678 adds the resultant final waveform segment to mix buffer 674; and in step 680 discards the request.

While periodic discarding could be accomplished other than on a per-substitution-cycle basis, further efficiency is gained by repetitive steps during each such cycle and the perceived impact on an ongoing performance as compared with less-frequent discarding is minimal.

FIG. 6*b* is a graph showing how using a modulated fully-synthesized final waveform segment when discarding waveform segments according to the present invention minimizes the detrimental impact on a sound performance. As with conventional sound engines, discarding a request with a corresponding unmodulated waveform segment 610 is likely to result in a waveform discontinuity at the start of the following cycle 603. Thus, to avoid waveform discontinuities, sound engine 270 synthesizes a modulated final waveform segment 620 prior to "discarding".

While many forms of amplitude and frequency modulation might be used, such as non-linear amplitude modulation 615, the preferred modulation requires little calculation and is therefore expedient while minimizing detrimental impact on ongoing sound performances. Thus, final waveform segment 620 is fully synthesized and modulated using a linearly decreasing amplitude envelope in which the current amplitude of the last sample of previous waveform segment 610*a* is divided by the number of samples comprising unmodulated waveform segment 610*b* and that amount is decremented from each successive sample synthesized, forming final waveform segment 620.

While the above description contains many specifics, these should not be construed as limitations on the scope of the invention but rather as examples of preferred embodiments thereof. Many other possibilities exist within the spirit and scope of this invention. For example, methods other than double-buffering are contemplated for providing continuous sound from the results of sequential synthesis. Examples of such methods include but are not limited to multi-buffering and circular-buffering.

A second example is that the invention accommodates many methods for storing, ordering, prioritizing and querying data based upon various criteria. For example, requests for substitute-synthesis or discarding can be selected according to criteria consistent with or calculated from the contents of a current request or all requests, such as the softest note, highest note, type of instrument or instruments, types of control information, midi-channel or those criteria of event-based methods other than midi and General midi. Selection criteria can also include data relating to an ongoing sound performance and/or the potential impact of a sound produced by synthesizing a current and/or future request.

A third example is that while specific synthesis methods are discussed, this is not to be construed as a limitation. The unmodulated, zero amplitude substitute waveform segment might for example include a decreasing amplitude modulation to further reduce noise. Where utilized, the last consecutive substitute waveform segment might restore the initial amplitude of the first substitute waveform segment, or the final amplitude of the last substitute waveform segment might be used to initiate the next waveform segment. Such first and last modulation might be different from one another. An embodiment using such modulation would require storing the final amplitude of the substitute waveform segment following step 466 (FIG. 4) to assure corresponding amplitudes during successive cycles. Another example is that the decreasing amplitude envelope of the concluding waveform segment can be other than continuous or linear. Other methods might also be more quickly implemented than full-synthesis in preserving requests with minimized perceived detrimental impact.

A fourth example is that substitution-synthesis might be further optimized. In cases where for example time reserved for substitute-synthesis exceeds time needed for full-synthesis of one or more waveform segments, the number of pending requests might be polled and full-synthesis time extended to assure full-synthesis of a maximized number of requests. Thus, a fixed time for full-synthesis is not a requisite and instead fixed or dynamic time referencing and/or conditions may be utilized in a determination that substitute-synthesis is required. Further, if time is utilized, then polling, interrupts and/or other methods for referencing a time indicator might be used. A further example is that, as illustrated, an attack portion of a sound may be preserved using substitution synthesis. Since a delayed attack becomes more obnoxious as the delay increases, the number of cycles during which a sufficiently new request is preserved might be limited such that an attack might be given a greater priority and/or a sufficiently delayed attack might be discarded.

A fifth example is that while the present sound engine has been illustrated as being embodied within a personal computer, it is expected that the invention will also be practiced in other systems having similar requisites. It is further anticipated that the invention will be utilized in such systems to the full extent of midi and processor-based capabilities. An ongoing process is for example intended to include all means for supplying internal and/or external event, wave and other request type sources. Other output and distributed processing means are similarly included. Other possibilities are also within the spirit and scope of the invention.

What is claimed is:

1. A method for real-time synthesis of a first waveform segment after synthesizing a preceding waveform segment and before synthesizing a following waveform segment, comprising the steps of:

determining an ending amplitude of the previous waveform segment;

synthesizing the first waveform segment to have a beginning amplitude determined by the ending amplitude of the preceding waveform segment;

determining a beginning amplitude of the following waveform segment; and synthesizing the first waveform segment to have an ending amplitude determined by the beginning amplitude of the following waveform segment.

2. The method of claim 1 wherein the first waveform segment beginning amplitude is equal to the preceding segment ending amplitude and the first waveform segment ending amplitude is equal to the following segment beginning amplitude.

3. The method of claim 2 wherein the first waveform segment has a constant amplitude.

4. The method of claim 1 wherein:

the first waveform segment includes an initial portion, a middle portion and a final portion;

if the preceding waveform segment is not a substitute waveform segment, then the initial portion is modulated; and if the following waveform segment is not a substitute waveform segment, then the final portion is modulated.

5. The method of claim 4 further comprising the step of modulating the initial portion with a decreasing amplitude envelope.

6. The method of claim 4 further comprising the step of modulating the final portion with an increasing amplitude envelope.

7. The method of claim 4 wherein the initial portion beginning amplitude is equal to the preceding waveform segment ending amplitude, the final portion ending amplitude is equal to the following waveform segment beginning amplitude, the modulation of the initial portion is a linearly decreasing amplitude envelope, the modulation of the final portion is a linearly increasing amplitude envelope, a final portion beginning amplitude is equal to an initial portion ending amplitude, and the substitute waveform segment otherwise has a constant amplitude.

8. A method for real-time synthesis of a concluding waveform segment which has an initial portion, a middle portion and a final portion, after synthesizing a preceding waveform segment which has an ending amplitude, comprising the steps of:

synthesizing the initial portion to have a beginning amplitude determined by the ending amplitude of the preceding waveform segment;

synthesizing the final portion to have an ending amplitude equal to zero; and synthesizing the middle portion to have a decreasing amplitude envelope.

9. The method of claim 8 wherein the initial portion beginning amplitude is equal to the preceding segment ending amplitude.

10. The method of claim 8 further comprising the step of modulating a fully-synthesized waveform segment with a linearly decreasing amplitude to generate the concluding waveform segment.

11. A method for real time synthesis of a waveform comprising the steps of:

if a time interval allotted to synthesis has not elapsed and if a waveform must still be synthesized, then I) determining if external constraints that govern synthesis of a substitute waveform segment are required, and if not, then synthesizing a fully-synthesized waveform segment during the time interval allotted to synthesis; and II) if synthesis of a substitute waveform segment is required, then synthesizing a substitute waveform segment.

12. The method of claim 11 further comprising the steps of:

adding any fully-synthesized waveform segment and any substitute waveform segment of waveform segments synthesized during the time interval allotted to synthesis to form a composite waveform segment, and if no waveform remains un-synthesized during the time interval allotted to synthesis or if the time interval allotted to synthesis has ended, then sending the composite waveform segment to an audio output system.

13. The method of claim 11 where in the step of determining if external constraints that govern synthesis of a substitute waveform segment are required includes the step of referencing a time indicator.

14. The method of claim 13 wherein the step of referencing a time indicator includes the steps of comparing a time indicator value to a full-synthesis time, and if the full-synthesis time has expired, then requiring a substitute waveform segment to be synthesized.

15. The method of claim 14 wherein the full-synthesis time is a constant value.

16. A method for real time synthesis of a waveform comprising the steps of:

if a time interval allotted to synthesis has not elapsed, then

I) determining whether synthesis of a substitute waveform segment or discarding a waveform is required, and if not, then if a waveform remains un-synthesized during the time interval allotted to synthesis, then synthesizing a fully synthesized waveform segment; and II) if synthesis of a substitute waveform segment is required, then if a waveform remains un-synthesized during the current time interval allotted to synthesis, then synthesizing a substitute waveform segment; and III) if discarding of a waveform is required, then synthesizing a concluding waveform segment to conclude the synthesis of that waveform and removes the need to continue the synthesis of that waveform in any succeeding time intervals allotted to synthesis.

17. The method of claim 16 further comprising the steps of:

adding a fully synthesized waveform segment, a substitute waveform segment and a concluding waveform segment of the waveform segments synthesized during the time interval allotted to synthesis to form a composite waveform segment, and if no waveform remains un-synthesized during the time interval allotted to synthesis or if the time interval allotted to synthesis has ended, then sending the composite waveform segment to an audio output system.

18. The method of claim 16 wherein the step of determining if discarding a waveform is required includes referencing a periodic schedule for discarding waveforms.

19. The method of claim 16 wherein the step of determining if discarding a waveform is required includes referencing a criteria for discarding a waveform and comparing the criteria with data for requested waveforms.

20. The method of claim 19 wherein data concerning requested waveforms is generated as part of the request for the waveform.

21. The method of claim 19 wherein data concerning requested waveforms includes data concerning all waveforms pending synthesis.

22. The method of claim 19 wherein data concerning requested waveforms relates to an impact of a sound produced by synthesis of the requested waveform.

23. A processor-based method for real time synthesis of a waveform, comprising the steps of:

examining whether a time interval allotted to synthesis of a first segment of a new waveform may be exceeded if the first waveform segment is synthesized, by comparing an estimated first synthesis time for full-synthesis of the first waveform segment against the time interval allotted to synthesis of a first segment of a new waveform; and if the time interval will be exceeded, synthesizing a second waveform segment, having a synthesis time of a shorter duration than the first waveform segment, to substitute for the first waveform segment.

24. The method of claim 23, wherein the second waveform segment follows a preceding waveform segment and precedes a following waveform segment.

25. The method of claim 24, wherein the second waveform segment has a beginning amplitude equal to the ending amplitude of the preceding waveform segment.

26. The method of claim 24, wherein the second waveform segment has an ending amplitude equal to the beginning amplitude of the following waveform segment.

27. The method of claim 23, wherein the second waveform segment has a constant amplitude.

28. The method of claim 23, further comprising the step of modulating an initial portion of the second waveform segment.

29. The method of claim 23, further comprising the step of modulating a final portion of the second waveform segment.

30. The method of claim 28, further comprising the step of modulating the initial portion with a decreasing amplitude envelope.

31. The method of claim 30, further comprising the step of modulating the final portion with an increasing amplitude envelope.

32. The method of claim 23, wherein the step of examining further includes examining aspects of musical content including importance of said new waveform in providing musical characteristics, including feedback, amplitude of the waveform, frequency of the waveform, wavelength of the waveform, and musical instrument which the waveform represents.

33. The method of claim 32, wherein the step of examining further comprises determining whether to provide a sense of quiet.

34. The method of claim 23, wherein the first waveform has sufficiently low musical importance.

35. A system for real time synthesis of a waveform including:

a controller for examining whether a time interval allotted to synthesis of a first waveform segment may be exceeded if the first waveform segment is synthesized by comparing an estimated first synthesis time for full-synthesis of the first waveform segment against the time interval allotted to synthesis of the first waveform segment; and a synthesizer coupled to the controller for synthesizing a second waveform segment, having a synthesis time of shorter duration than the first waveform segment, to substitute for the first waveform segment when the controller determines that the time interval allotted to synthesis of the first waveform segment may be exceeded.

36. The system of claim 35, wherein the second waveform segment follows a preceding waveform segment and precedes a following waveform segment.

37. The system of claim 36, wherein the second waveform segment has a beginning amplitude equal to an ending amplitude of the preceding waveform segment.

38. The system of claim 36, wherein the second waveform segment has an ending amplitude equal to a beginning amplitude of the following waveform segment.

39. The system of claim 35, wherein the second waveform segment has a constant amplitude.

40. The system of claim 36, wherein the controller modulates an initial portion of the second waveform segment.

41. The system of claim 36, wherein the controller modulates a final portion of the second waveform segment.

42. The system of claim 40, wherein the controller modulates the initial portion with a decreasing amplitude envelope.

43. The system of claim 41, wherein the controller modulates the final portion with an increasing amplitude envelope.

* * * * *